US010617166B1

(12) United States Patent
Summerlin

(10) Patent No.: US 10,617,166 B1
(45) Date of Patent: Apr. 14, 2020

(54) PROTECTIVE HELMET ATTACHMENT

(71) Applicant: James C. Summerlin, Little Rock, AR (US)

(72) Inventor: James C. Summerlin, Little Rock, AR (US)

( * ) Notice: Subject to any disclaimer, the term of this patent is extended or adjusted under 35 U.S.C. 154(b) by 0 days.

(21) Appl. No.: 16/376,823

(22) Filed: Apr. 5, 2019

(51) Int. Cl.

| | |
|---|---|
| ***A41D 13/015*** | (2006.01) |
| ***A42B 3/04*** | (2006.01) |
| ***A63B 71/12*** | (2006.01) |
| ***A63B 71/10*** | (2006.01) |
| *A41D 13/00* | (2006.01) |

(52) U.S. Cl.
CPC ..... *A42B 3/0473* (2013.01); *A63B 71/10* (2013.01); *A63B 71/1291* (2013.01)

(58) Field of Classification Search
CPC ..... A42B 3/0473; A42B 3/064; A42B 3/08; A42B 3/121; A42B 3/105; A41D 13/0512; A41D 13/0531; A41D 2500/00; A41D 2600/10; A41D 13/0153; A41D 13/0518; A63B 71/1291; A63B 71/10; A63B 2220/53; A63B 2243/007; A63B 71/081; A63B 2102/14; A63B 2102/24; A63B 2220/16; A63B 2220/40; A63B 2243/0025; A63B 23/025; A63B 71/12; A63B 2209/10; A63B 2220/00; A63B 2220/836; A63B 71/06; F41H 1/04; A61B 2503/10; A61B 5/11; A61B 5/6803
See application file for complete search history.

(56) References Cited

U.S. PATENT DOCUMENTS

| | | | | | |
|---|---|---|---|---|---|
| 3,134,106 | A * | 5/1964 | Shaffer | A42B 3/0473 | 2/462 |
| 4,094,015 | A | 6/1978 | Howard | | |
| 4,825,476 | A * | 5/1989 | Andrews | A42B 3/0473 | 2/421 |
| 4,999,855 | A * | 3/1991 | Brown | A42B 3/0473 | 2/421 |
| 5,261,125 | A * | 11/1993 | Cartwright | A42B 3/0473 | 2/421 |
| 5,353,437 | A * | 10/1994 | Field | A41D 13/0153 | 2/421 |
| 5,444,870 | A * | 8/1995 | Pinsen | A42B 3/0473 | 2/411 |
| 5,493,736 | A * | 2/1996 | Allison | A42B 3/0473 | 2/411 |
| 5,517,699 | A * | 5/1996 | Abraham, II | A42B 3/0473 | 2/205 |
| 5,581,820 | A * | 12/1996 | Cartwright | A42B 3/0473 | 2/421 |

(Continued)

*Primary Examiner* — Robert H Muromoto, Jr.

(57) ABSTRACT

A protective helmet attachment connects a helmet to a set of shoulder pads. The attachment includes a set of links that are attached to the helmet, and are adapted to ride within an annular track situated around the head opening in the shoulder pads. The links redistribute the force from a blow to the head down to the shoulders and body. The links may be of one piece that is rigidly attached to the helmet, thus providing maximum protection. Alternatively, the links may be formed of two pieces that are pivotally connected using a shoulder bolt, thus somewhat reducing the level of protection afforded against a blow to the front or back of the head but maintaining the ability to tilt the head.

17 Claims, 6 Drawing Sheets

(56) References Cited

U.S. PATENT DOCUMENTS 5,794,270 A * 8/1998 Howat ..... A42B 3/0473 2/410
5,930,843 A * 8/1999 Kelly ..... A41D 13/0512 2/421
RE36,691 E * 5/2000 Pinsen ..... A42B 3/0473 2/411
6,182,300 B1 * 2/2001 Severance ..... A42B 3/0473 2/425
6,253,389 B1 * 7/2001 Scaglione ..... A41D 13/0518 2/421
6,385,781 B1 * 5/2002 Rose ..... A42B 3/00 2/421
6,481,026 B1 * 11/2002 McIntosh ..... A41D 13/0512 2/416
6,588,022 B1 * 7/2003 Anders ..... A42B 3/00 2/421
6,591,430 B1 * 7/2003 Sledge ..... A42B 3/0473 2/421
6,874,170 B1 * 4/2005 Aaron ..... A41D 13/0512 2/468
6,968,576 B2 * 11/2005 McNeil ..... A42B 3/0473 2/425
6,971,123 B2 * 12/2005 Weaver ..... A42B 3/0473 2/411
7,371,221 B1 * 5/2008 Baker ..... A61F 5/055 602/18
7,849,525 B2 * 12/2010 Ghajar ..... A42B 3/046 2/410
8,321,965 B2 * 12/2012 Newman ..... A42B 3/0473 2/410
8,590,064 B1 * 11/2013 Castillo ..... A42B 3/0473 2/411
8,621,672 B2 * 1/2014 Chuback ..... A41D 13/0512 2/421
8,834,394 B2 * 9/2014 Ghajar ..... A61F 5/055 128/846
8,914,916 B2 * 12/2014 Castillo ..... A42B 3/0473 2/411
9,462,841 B1 * 10/2016 Popejoy ..... A41D 13/0512
9,826,792 B2 * 11/2017 Dowd ..... A42B 3/185
10,016,006 B2 * 7/2018 Popejoy ..... A41D 13/0512
10,258,097 B2 * 4/2019 Popejoy ..... A41D 13/0512
2002/0100109 A1 * 8/2002 Hoop ..... A41D 13/0512 2/425
2013/0205480 A1 * 8/2013 Nagely ..... A63B 71/1291 2/425
2016/0366970 A1 * 12/2016 Lewis ..... A42B 3/0473
2017/0251742 A1 * 9/2017 Partlo ..... A42B 3/0473
2018/0147474 A1 * 5/2018 Hodge ..... A63B 71/1291

* cited by examiner

PROTECTIVE HELMET ATTACHMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

In recent years, a great deal of attention has been focused on repetitive brain injuries suffered by football players. These repetitive brain injuries may lead to chronic traumatic encephalopathy (CTE), a degenerative brain disease. The most recent research suggests that the disease may result from repetitive blows to the head, even if those impacts do not result in full concussions. The adverse effects of CTE may not be felt by a player during his playing years, but effects later in life can be very severe. A number of former football players suffer significant levels of dementia or even premature death due to these repetitive injuries.

Some have suggested that football players know the risks of the sport, and thus have assumed the risk of this type of injury by deciding to participate. Many persons involved in football, however, see a warning alone as inadequate. Professional football players often come from a low-income background, and may feel obligated to undergo these risks in order to support themselves and their families. This applies to college players as well, who may have no means by which to afford a college education other than through a football scholarship. Many thus feel that football leagues and organizations have an obligation to protect the boys and men who play this sport. Now that these adverse effects are becoming better understood, a significant number of parents have refused to allow their sons to play football. If no adequate protection is found against CTE, then the public may lose interest in football altogether, as people come to see it as a sport that is simply too dangerous to merit their support.

Football programs such as the National Football League have begun to address this problem. For example, the NFL now implements a "concussion protocol" that requires certain tests be performed before a player who has suffered a significant blow to the head may be allowed back in the game. But because it is now known that it is the repetitive nature of the blows that leads to CTE, and not necessarily the force of one particular blow, it will be understood that the conclusion protocol is inadequate on its own to fully protect players from adverse effects of CTE later in life. In addition, the NFL has instituted a number of rules changes intended to reduce the number of blows to the head that are suffered during play. These rules also cannot fully protect players, because head-to-head collisions are often unintentional; for example, even though a defensive player may redirect his head away from an offensive player's head as he begins a tackle, the offensive player may inadvertently move his head into the path of the defensive player while trying to avoid the tackle, and the dangerous collision nevertheless occurs. Many defensive backfield players have become frustrated with these rules, which severely penalize them even in situations where there would be no practical way for the player to avoid the dangerous head-to-head collision. Another problem is that many of the head-to-head collisions occur between players on the same team, such as when two players attempting to make a tackle from different angles miss the ball carrier and instead strike each other. No rules changes will prevent this sort of dangerous impact.

There has been a great deal of research and development in recent years toward improving the helmet worn by football players in order to better protect players from harm. Although the new helmet designs do improve upon the older designs, they are incremental in nature and do not provide full protection to the player from head-to-head collisions, hits to the side of the head, or hits to the back of the helmet (which often result from a player being knocked to the ground and the back of the helmet striking the ground). The reason that these designs have not been fully successful is that the amount of padding that would provide full protection to a player would make the helmet so large that it could not practically be worn during play. This is not a function of the quality of the padding or design of the helmet, but is simply a limitation imposed by physics given the very large amount of energy imposed upon the helmet during a head-on collision between two very strong, very fast athletes.

For all of these reasons, it would be highly desirable to develop an apparatus that would fully protect a football player from brain injuries, regardless of whether the hit occurs at the front of the helmet, the side of the helmet, or the rear of the helmet. Furthermore, given the very large investment in existing helmets and related technology, it would also be desirable to develop such an apparatus that can be used with existing helmet designs.

References mentioned in this background section are not admitted to be prior art with respect to the present invention.

BRIEF SUMMARY OF THE INVENTION

The present invention is directed to a protective helmet attachment that connects a helmet to a set of shoulder pads. The attachment includes a set of links that are attached to the helmet, and are adapted to ride within an annular track situated on the shoulder pads such that the player's head may fit through the annular track. In certain implementations, the links include a flange that extends laterally, with the annular track sized to receive the lateral flange and thereby hold the links in place within respect to the annular track while in use. By locking the links in place with respect to the annular track, it may be seen that the player's helmet is thus locked to the annular track. In certain implementations, the links are rigidly attached to the helmet and thereby prevent the player from moving his head up or down while wearing the attachment. In other implementations, the links are formed of two separate parts, those parts being pivotally linked together. This arrangement enables the player to also tilt his head up or down while wearing the attachment. In either case, implementations of the invention include the use of a mat and straps to firmly connect the attachment to the player's shoulder pads, and more evenly distribute the force of a blow to the head onto the shoulders, back, and chest of the player.

Because the annular track is mounted to the shoulder pads and the links that ride within the annular track are mounted to the helmet, the attachment creates a connection between the player's helmet and shoulder pads. Thus when the player receives a blow to the head, the force of the blow is redistributed down onto the shoulder pads, while the head and neck are protected from this force. In the case of the helmet being rigidly connected to the single-piece links, the greatest level of protecting is afforded because there is no risk of the player's head being snapped up or down due to a frontal or rear blow. This implementation of the invention may therefore be preferred for players such as linemen, because these players do not need to tilt their heads to the same degree as other players. In the case of the helmet being connected by two-piece links that are pivotally jointed together, the protection from a frontal or rear blow is somewhat reduced, but the player retains the ability to turn his head upward and downward. This may be the preferred implementation for players who must be able to also tilt their heads in order to effectively play their position, such as wide receivers, quarterbacks, running backs, kickers, punters, and defensive backs. In either case, the player is afforded much greater protection than can be afforded by an unsupported helmet, no matter how well the helmet is designed. In addition, the attachment would be used with existing helmets and shoulder pads, so that no replacement of this expensive equipment is required. This further allows for football teams to upgrade their helmet and shoulder pad choices as better equipment becomes available, without the need for replacing the attachment.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Before the present invention is described in further detail, it should be understood that the invention is not limited to the particular embodiments described, and that the terms used in describing the particular embodiments are for the purpose of describing those particular embodiments only, and are not intended to be limiting, since the scope of the present invention will be limited only by the claims.

Figure 1:
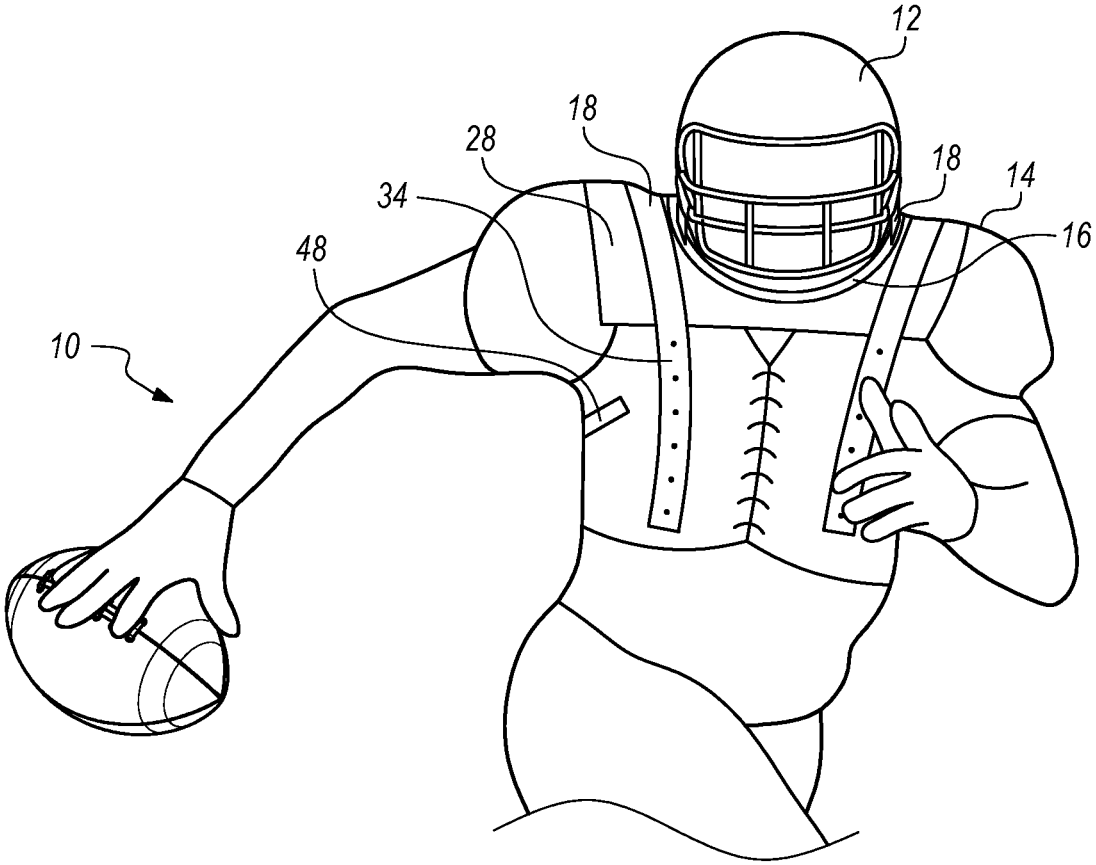
FIG. 1 is a perspective view of a football player wearing an implementation of the present invention.

With reference now to FIG. 1, a general description of a first implementation of the invention may be described. Player 10 is shown wearing a conventional helmet 12 and shoulder pads 14. Helmet 12 and shoulder pads 14 are connected together, however, by links 18, circular track 16, mat 28, and shoulder pad straps 34. Links 18 may move freely within circular track 16, thus allowing the helmet to turn and thereby allowing the player to fully turn his head from side to side. Mat 28 provides a wide connection point between circular track 16 and shoulder pads 14 that distributes force more evenly. Shoulder pad straps 34 are permanently attached to mat 28, although in alternative embodiments shoulder pad straps 34 could be made removable. Shoulder pad straps 34 also are attached, either permanently or removably, to shoulder pads 14 at the top and also down both the front and back areas of the shoulder pads. In this way, circular track 16 is held firmly in place with respect to shoulder pads 14 and stresses picked up by straps 34 can redistribute reactional forces over areas of the chest and back as well. In addition, underarm straps 48 wrap around from the back and under the arms to attach at the front of shoulder pads 14 to provide more support for the connection between shoulder pads 14, circular track 16, and chest and back areas of the shoulder pads.

Figure 2:
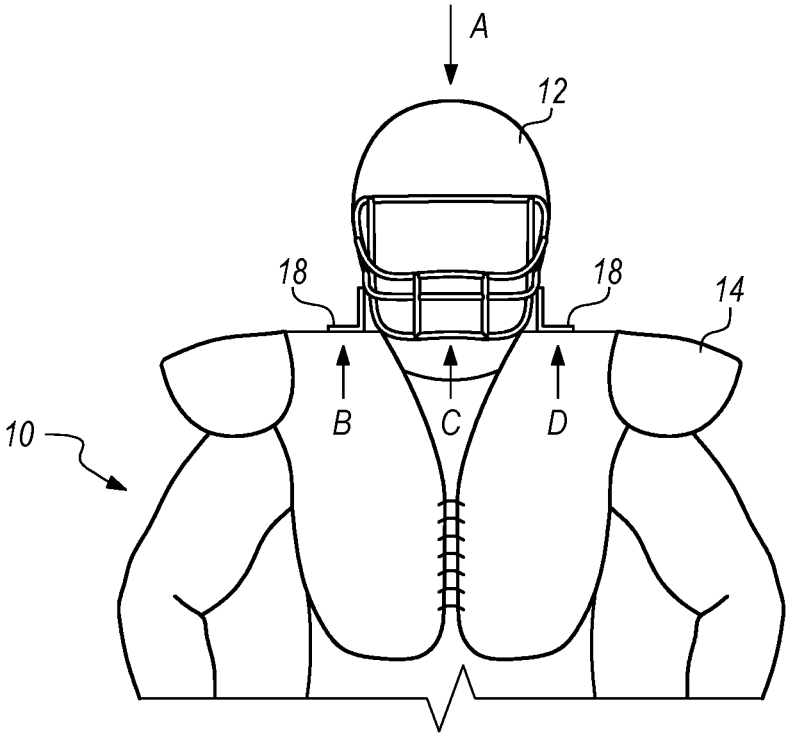
FIG. 2 is a force diagram illustrating the forces to the head of a player in the case of a head-on impact.

FIG. 2 is a force diagram showing the resulting forces from a direct head impact for a player 10 wearing the first or second implementation of the invention. Newton's third law of motion states that for every action there is an equal and opposite reaction. Thus the result of downward force A would be a reaction force in the opposite direction, all of which would be imparted to the head and neck of player 10. Using the first or second implementation of the invention, however, the resulting forces are as illustrated in FIG. 2. Most of the reaction to downward force A will be distributed through links 18 to shoulder pads 14, resulting in reaction force B at the right shoulder and reaction force D at the left shoulder. Reaction force C at the head and neck would be minimal, having been reacted through the much softer and less stiff path of the helmet and padding around the head. The sum of each of these forces is equal in magnitude to force A, but such individual force in this case is greatly reduced by spreading most of the force around circular track 16 as the force is transmitted to shoulder pads 14. In addition, it will be seen that only a minimal force is imparted to the head and neck, and instead almost all of the force is transmitted through shoulder pads 14 to the left shoulder, right shoulder, back, and chest of player 10. Player 10's head is thus amply protected from the impact in this example.

Figure 3:
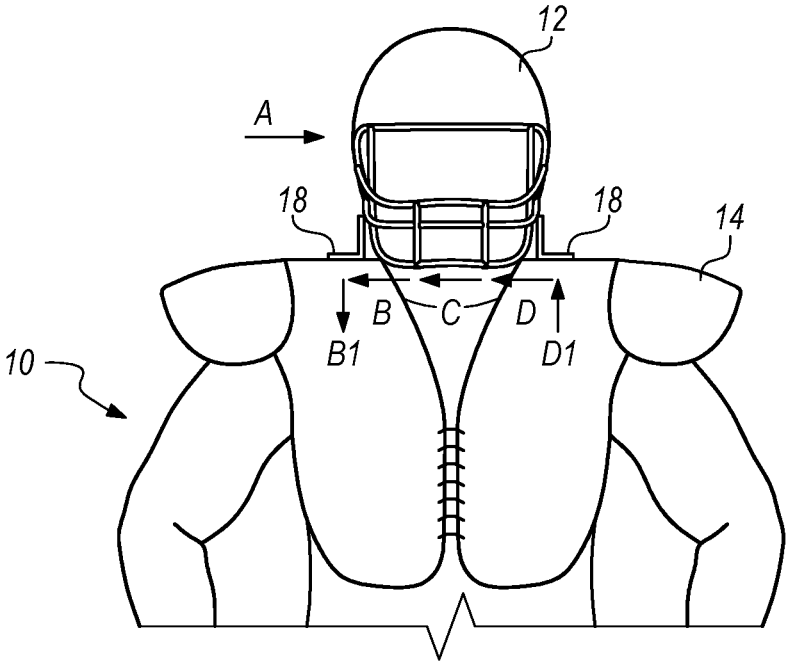
FIG. 3 is a force diagram illustrating the forces to the head of a player in the case of an impact to the side of the head.

FIG. 3 is a force diagram similar to FIG. 2, but in this case player 10 receives a blow to the side of helmet 12 creating a lateral force A. If the player were wearing only helmet 12 and shoulder pads 14, then the result would be a strong lateral force in the opposite direction that would be felt to the player's head and neck as well as a sideways "bending moment" of the neck due to the blow to the head and reaction force at the base of the neck not being along the same alignment. But if player 10 is using the first or second implementation of the invention, then the resulting forces are as illustrated in FIG. 3. Reaction forces B, C, and D in this case are also felt laterally, moving in the opposite direction to force A. But most of this force is redirected by links 18 down into the shoulders, back, and chest of player 10 and only minimal at the head and neck. In addition, to the extent that force A is not in direct alignment with the reaction forces B and C causing a sideways "bending moment" tendency to the neck, there is a downward component of the reactive force B1 on one side of shoulder pads 14, and an upward component of the reactive force D1 on the other side of shoulder pads 14. As with the example of FIG. 2, player 10's head and neck are also protected from the impact because links 18 serve to transmit the force away from the head and neck and down into the shoulders, back, and chest, thereby completely eliminating the sideways bending tendency to the neck.

Figure 4:
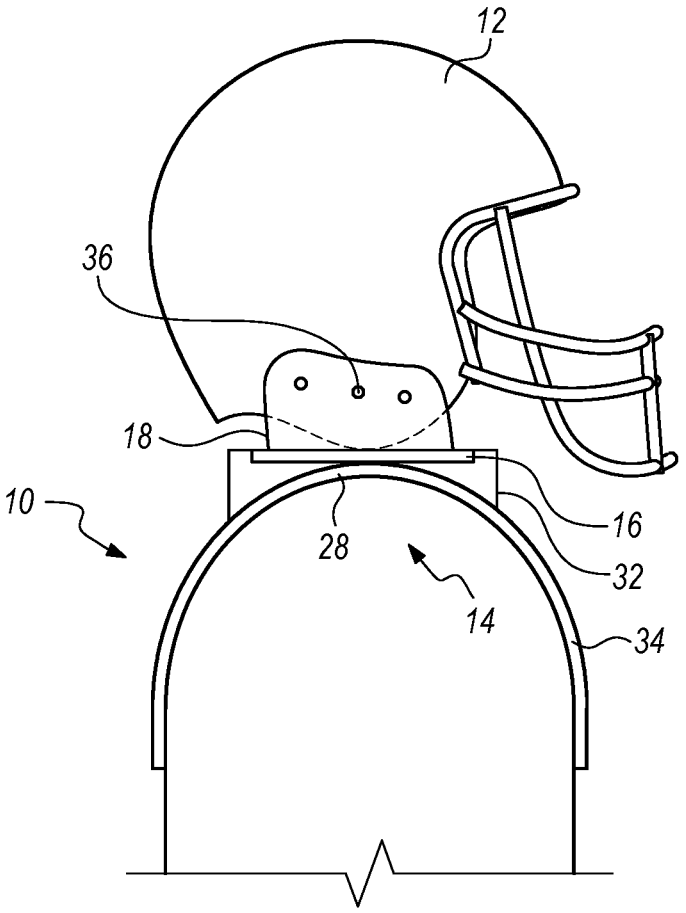
FIG. 4 is a side elevational view of a football player wearing a first implementation of the present invention.

Regarding the structure of the first implementation of the invention, FIG. 4 is a side view of a player 10. Helmet 12 is connected to links 18 in a rigid manner. As illustrated, multiple helmet bolts 36 and a hardened cement filler (not shown in this view) are used to make this firm connection. Each link 18 rides within annular track 16, thus allowing player 10 to turn his head from side to side. Track support frame 32 is fitted underneath and supports annular track 16. The bottom side of track support frame 32 presents a concave surface that is shaped to match the convex curvature on the top of shoulder pads 14; in this way, the connection between annular track 16 and shoulder pads 14 is made more secure and more comfortable for player 10, and force is more evenly distributed. Underneath track support frame 32 is mat 28, which further serves to secure the connection to shoulder pads 14 and spread out the forces of impact experienced by player 10. Shoulder pad straps 34 extend downwardly over mat 28 and are connected to the front and back of shoulder pads 14. As can be seen, this first implementation of the invention allows player 10 to turn his head, but does not allow player 10 to tilt his head up or down, thereby providing maximum protection. This implementation of the invention may thus be suitable for linemen; these players suffer the greatest number of head impacts during play and thus may need the most protection, but also do not need the same range of head movement required for other players.

Figure 5:
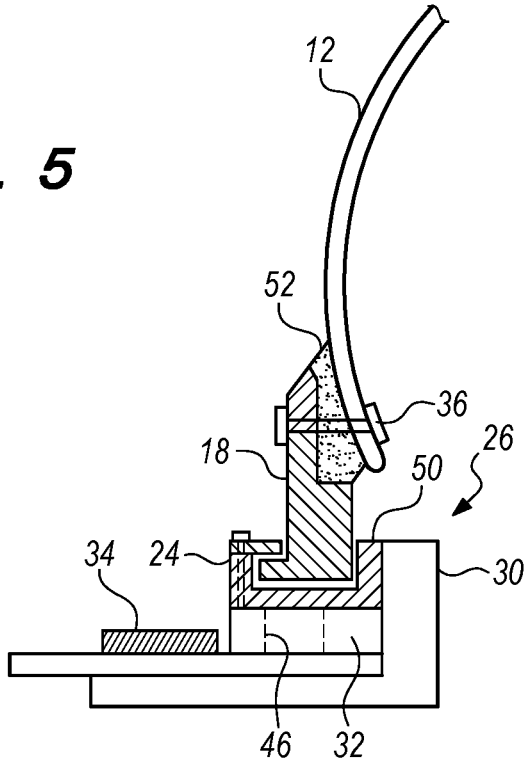
FIG. 5 is a cut-away view of the attachment assembly taken at the shoulders according to the first implementation of the invention.
Figure 6:
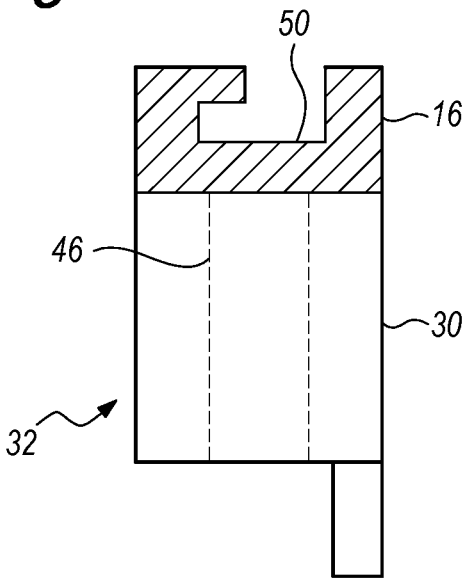
FIG. 6 is a cut-away view of the attachment assembly taken at the front or back according to the first or a second implementation of the invention.

FIG. 5 is a detail of a portion of the first implementation of the invention, being a cut-away view at the side when the player is facing forward. FIG. 6 is a cut-away view at the front or back of the first or second implementation of the invention. Thus FIG. 5 shows a cut-away view of a link 18 and its associated components, whereas FIG. 6 shows circular track 16 without a link 18. Each link 18 is connected to helmet 12 by helmet bolts 36 and a hardened cement 52, as previously described. Cement 52 or other fill material is used to provide a secure area of contact. Each link 18 has a flange 24 at its lower end, which is sized to fit in the slot 26 of circular track 16. The contact areas of links 18, slot 26, or both may be coated with a low-friction coating 50. In one example, this coating may be polytetrafluoroethylene (PTFE), such as marketed under the brand name Teflon by the Chemours company. Links 18 and circular track 16 may be formed of a strong, lightweight metal, such as titanium. Circular track 16 is connected to track support frame 32 by track fasteners 46. Track frame 32 may be formed of a hard plastic material, in one example being the same material used to form the outer shell of helmet 12. A lip on track support frame 32 receives shoulder pad straps 34. Finally, a cushion 30 may be attached to the inside of circular track 16 and track frame 32, in order to provide further protection and comfort to player 10. Cushion 30 may be formed of the same material as the filling within helmet 12.

Figure 7:
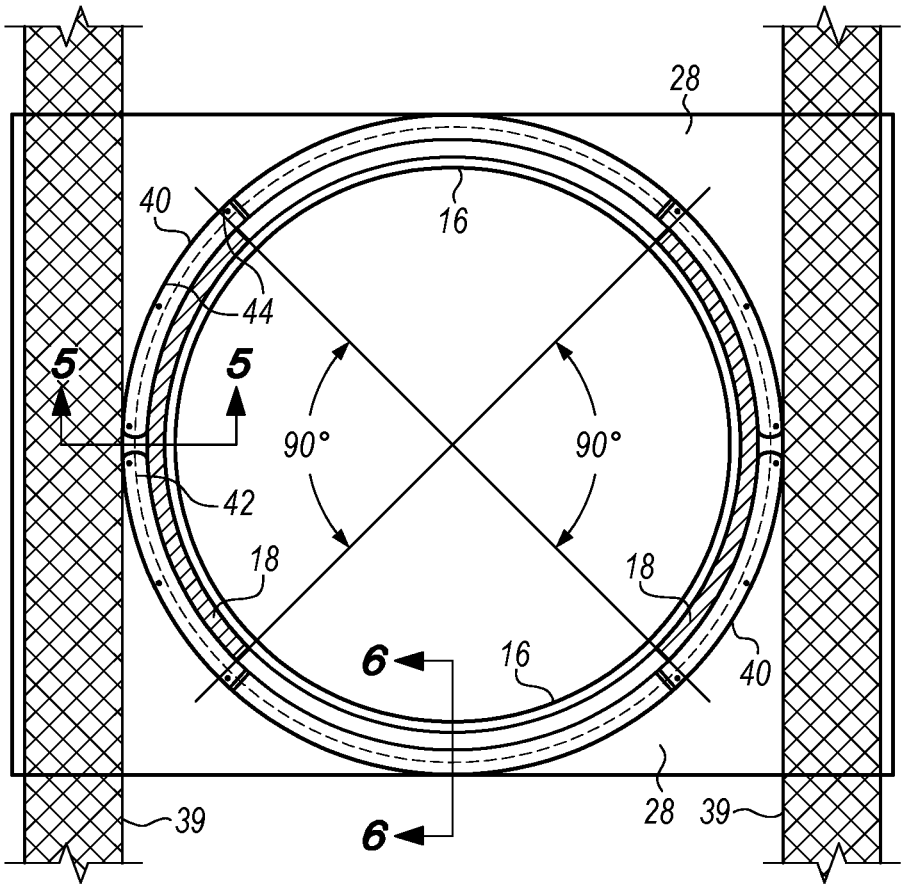
FIG. 7 is a top plan view annular track and related components according to either the first or second implementation of the invention.

FIG. 7 provides a top view of the first or second implementation of the invention. It may be seen that each of the two links 18 is allowed to move freely around circular track 16 for a full 180°, thus providing player 10 with full side-to-side head movement. Mat 28 lies under shoulder pad straps 34 as previously described. Two brackets 40, positioned opposite to each other on circular track 16, provide a means of removing links 18 from circular track 16, and thereby allowing player 10 to remove helmet 12 while wearing shoulder pads 14. Each bracket 40 pivots open or closed around a permanent bracket pin 42. One or more removable bracket pins 44 lock each bracket 40 in place when they are in place, while removal of removable bracket pins 44 allows player 10 to pivot brackets 40 to the open position and then remove helmet 12 from his head.

As players' heads, shoulders, and chests vary in size, it is also necessary for the size of the circular track 18 and support frame 32 to vary in size in order to properly fit each player 10. Once these proper sizes are determined for the player, it is then necessary to fit the player for the proper vertical dimension between the helmet 12 and links 18. This is accomplished by first placing on player 10 the circular track 18 with support frame 32, then placing the properly sized helmet 12 onto the player 10. Where the sides of helmet 12 meet against links 18, the void is filled with cement 52 and held in place to allow the cement to cure and harden. Then bolts 36 are drilled and secured in place. This procedure is a way to account for the various neck dimensions that vary from one player to another.

Figure 8:
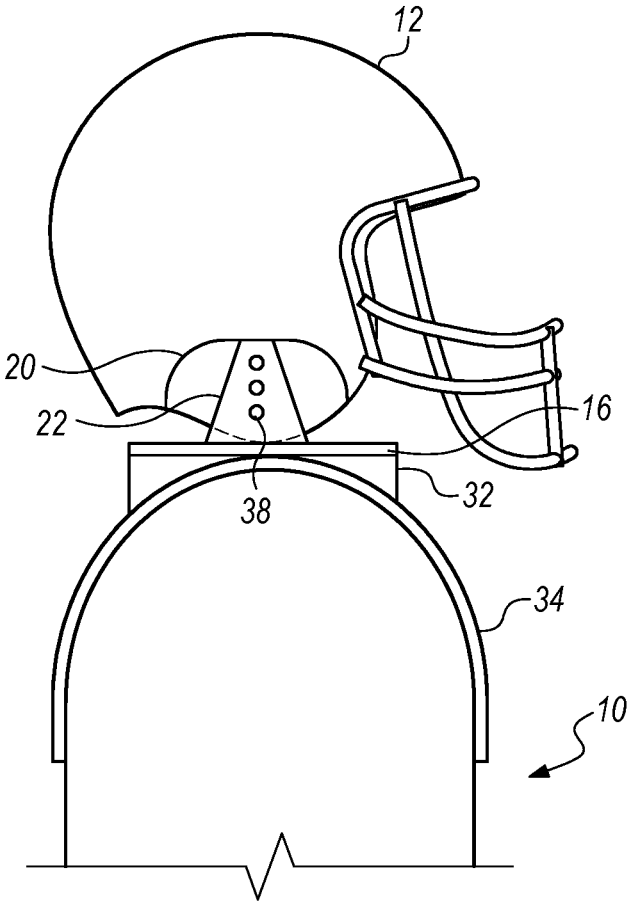
FIG. 8 is a side elevational view of a football player wearing the second implementation of the present invention.
Figure 9:
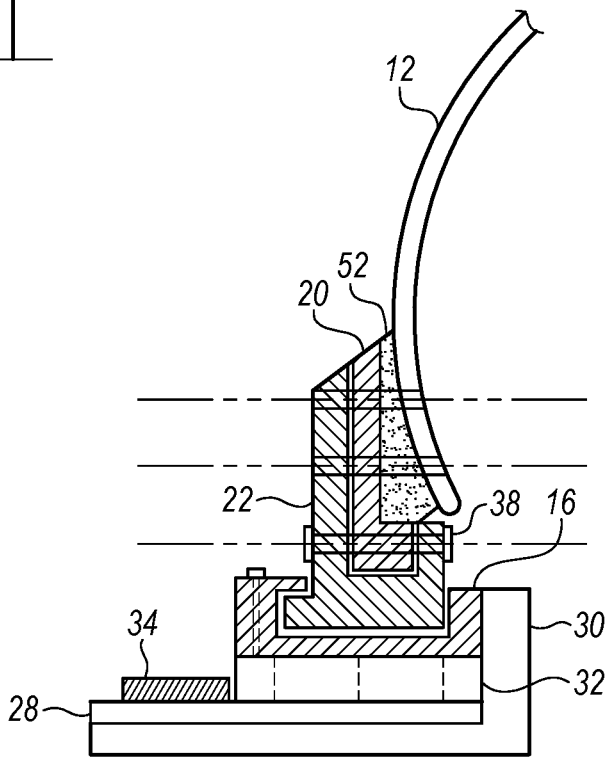
FIG. 9 is a cut-away view of the attachment assembly taken at the shoulders according to the second implementation of the invention.

FIGS. 8 and 9 illustrate a second implementation of the invention, in a side view and detail cut-away view, respectively. The change from FIGS. 4 and 5 is that each single link 18 is replaced by an upper link 20 and a lower link 22, which are pivotally connected together by shoulder bolt 38. This implementation of the invention affords player 10 with the ability to tilt his head up and down, as upper link 20 pivots forward and backward with respect to lower link 22 on shoulder bolt 38. This second implementation of the invention does not provide the same level of protection to player 10's head and neck as afforded by the first implementation, particularly with respect to certain frontal and rear impacts. This second implementation of the invention may, therefore, be more appropriate for use by quarterbacks, running backs, receivers, defensive backs, punters, and kickers, all of whom are required to be able to tilt their heads up and down in order to effectively play their positions. It will be recognized that these players often suffer the most forceful head impacts while playing, but as noted above, current research shows that it is not those high-energy concussive impacts that correlate with CTE, but rather it is repeated lower-level impacts. These players suffer fewer impacts during play, and thus may not need the higher level of protection that the first implementation of the invention provides to linemen.

The process of fitting the second implementation to the player is similar to the first implementation with a few additional steps. After the proper sizes of helmet 12 and shoulder pads 14 have been fitted to the player, and shoulder bolt 38 is in place thereby connecting upper links 20 to lower links 22, cement 52 is applied in the void between the upper links 20 and the wall of helmet 12. After cement 52 has adequately cured and hardened, and shoulder bolts 38 are securely in place, additional shoulder bolt holes are drilled located in a vertical line directly above lower links 22. Afterward, shoulder bolts 38 are moved from one hole to another to find the most comfortable location to the player for up and down vertical movement of the head.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. When a grouping is used herein, all individual members of the group and all combinations and subcombinations possible of the group are intended to be individually included. When a range is stated herein, the range is intended to include all subranges and individual points within the range. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention, as set forth in the appended claims.

The invention claimed is:

1. An apparatus for preventing brain injuries to a person wearing a helmet and shoulder pads, the apparatus comprising:

a. at least two links, each link comprising an upper end and a lower end, and each lower end comprising at least one flange;

b. an annular track comprising a slot to receive the flanges of the at least two links whereby the links are locked in the annular track and movable in a circular pattern around the annular track;

c. an annular support frame mounted at a bottom side of the annular track;

d. at least two straps attacked to the annular support frame and to the shoulder pads; and e. a mat positioned between the annular support frame and the shoulder pads, wherein the annular track is mounted on the shoulder pads and wherein the upper end of each of the at least two links is mounted to the helmet.

2. The apparatus of claim 1, further comprising an annular cushion positioned on an inner side of one or both of the annular support frame and the annular track.

3. The apparatus of claim 2, further comprising a low-friction layer between the flanges of the lower ends of the at least two links and the slot of the circular track.

4. The apparatus of claim 3, further comprising at least one bracket attached to the circular track whereby each of the at least two links may be removed or placed within the circular track by opening the at least two brackets.

5. The apparatus of claim 4, further comprising a permanent bracket pin pivotally connecting the bracket to the circular track.

6. The apparatus of claim 5, further comprising at least one removable bracket pin connecting the bracket and the circular track to lock the bracket in place and thereby retain the at least two links within the circular track during use.

7. The apparatus of claim 1, wherein the upper end of each of the at least two links is rigidly attached to or integral with the lower end of one of the at least two links.

8. The apparatus of claim 7, further comprising at least two helmet bolts, each helmet bolt passing through and connecting together the upper end of one of the at least two links and the helmet.

9. The apparatus of claim 1, wherein the upper end of each of the at least two links is separate from but pivotally connected to a lower end of each of the at least two links whereby the person may tilt his or her head up and down while wearing the helmet.

10. The apparatus of claim 9, further comprising at least two shoulder bolts, wherein each shoulder bolt pivotally connects the upper end of one of the at least two links to the lower end of such one of the at least two links.

11. An apparatus for preventing brain injury to a person, comprising:

a. a helmet comprising a left side and a right side;

b. a set of shoulder pads;

c. a first link, wherein the first link is rigidly mounted to the left side of the helmet;

d. a second link, wherein the second link is rigidly mounted to the right side of the helmet;

e. an annular track mounted above and rigidly with respect to the shoulder pads, the annular track comprising a slot to receive the first link and the second link whereby the first link and the second link are movable around the annular track but are retained within the annular track; and f. a mat positioned between the annular track and the set of shoulder pads.

12. The apparatus of claim 11, further comprising:

a. a first helmet bolt connecting the first link to the left side of the helmet; and b. a second helmet bolt connecting the second link to the right side of the helmet.

13. The apparatus of claim 12, further comprising a track support frame connected to the annular track and positioned between the set of shoulder pads and the annular track.

14. An apparatus for preventing brain injury to a person, comprising:

a. a helmet comprising a left side and a right side;

b. a set of shoulder pads;

c. a first upper link piece, wherein the first upper link piece is rigidly mounted to the left side of the helmet;

d. a second upper link piece, wherein the second upper link piece is rigidly mounted to the right side of the helmet;

e. a first lower link piece pivotally connected to the first upper link piece;

f. a second lower link piece pivotally connected to the second upper link piece;

g. an annular track mounted above and rigidly with respect to the shoulder pads, the annular track comprising a slot to receive the first lower link piece and second lower link piece whereby the first lower link piece and the second lower link piece are movable around the annular track but are retained within the annular track; and h. a mat positioned between the annular track and the set of shoulder pads.

15. The apparatus of claim 14, further comprising:

a. a first shoulder bolt pivotally connecting the first upper link piece and the first lower link piece; and b. a second shoulder bolt pivotally connecting the second upper link piece and the second lower link piece.

16. The apparatus of claim 15, further comprising a track support frame connected to the annular track and positioned between the set of shoulder pads and the annular track.

17. The apparatus of claim 16, wherein the first lower link piece comprises a first lateral flange and the second lower link piece comprises a second lateral flange, wherein the annular track is sized to receive the first lateral flange and the second lateral flange in order to retain the first lower link piece and second lower link piece within the annular track.

* * * * *